United States Patent [19]

Blackford et al.

[11] Patent Number: 4,693,732

[45] Date of Patent: Sep. 15, 1987

[54] PISTON VIBRATOR

[75] Inventors: William L. Blackford, Peoria, Ill.; Greg Zakharin, Encino, Calif.

[73] Assignee: Martin Engineering Company, Neponset, Ill.

[21] Appl. No.: 16,229

[22] Filed: Feb. 19, 1987

[51] Int. Cl.[4] ..... B03C 3/76

[52] U.S. Cl. ..... 55/112; 173/115

[58] Field of Search ..... 55/112, 300; 173/115, 173/133

[56] References Cited

U.S. PATENT DOCUMENTS

| | | | |
|---|---|---|---|
| 1,138,179 | 5/1915 | Bayles | 173/133 X |
| 1,545,118 | 7/1925 | Bayles | 173/133 X |
| 3,030,753 | 4/1962 | Pennington | 55/112 |
| 3,182,733 | 5/1965 | Wigren | 173/115 |
| 3,504,480 | 4/1970 | Copcutt et al. | 55/112 |
| 3,547,207 | 12/1970 | Warrington | 173/133 X |
| 3,605,915 | 9/1971 | Gately et al. | 55/112 X |
| 3,838,741 | 10/1974 | Pepe | 173/115 |
| 4,409,007 | 10/1983 | Torrey et al. | 55/112 |

*Primary Examiner*—Kathleen J. Prunner

*Attorney, Agent, or Firm*—Mann, McWilliams, Zummer & Sweeney

[57] ABSTRACT

A piston vibrator adapted for use in vibrating insulated structures through a rod or other vibration-transmitting structure, the vibrator including a piston slidably disposed in a cylinder defined in a housing, the piston associated with a strike surface and a selective adjustment mechanism associated with the housing which can be used to eliminate slack between the strike surface of the vibrator and the rapping rod and which can be further used to externally adjust the pre-load on the rapping rod and to align the vibrator axially with the rod and to compensate for thermal expansion and contraction.

6 Claims, 3 Drawing Figures

PISTON VIBRATOR

BACKGROUND OF THE INVENTION

Piston vibrators have been used to vibrate metal plate and wire electrodes, through rapping rods, in electrostatic precipitators to remove from the electrodes accumulations of precipitated dust. Accumulated dust is undesirable since it loads up the electrodes, short-circuiting them, and reducing the efficiency of the apparatus in the performance of its precipitating function. Various arrangements of this general type are shown in U.S. Pat. Nos. 1,758,404, 2,525,325, 2,552,771, 2,699,224, 2,777,535, 2,854,089, 2,985,802, 3,030,753, 3,570,628, and 3,605,915. Most prior art vibrator arrangements of this type have many drawbacks since they do not effectively transmit the shock wave to the rapper rod because the entire vibrator case must be accelerated. Furthermore, slack often exists between the vibrator housing or strike surface and the rapping rod which dramatically detracts from an effective transmission of force. None of the prior art arrangements have provided a mechanism whereby the rapping rod can be adjustably pre-loaded to tune each individual rapper rod and its corresponding plates or wires.

SUMMARY OF THE INVENTION

The present invention consists of a piston vibrator adapted for use in vibrating electrodes in an electrostatic precipitator or baffle plates or turning vanes or other insulated structures vibrated through a rod or other vibration-transmitting device. The vibrator includes a selective adjustment mechanism operable initially to adjust the position of the vibrator housing and strike surface with respect to the rapping rod to eliminate any slack. The mechanism is further adjustable to selectively vary the force or preload exerted by the housing and its strike surface on the rapping rod thereby individually adjusting the pre-load on each rapper rod and its corresponding plates or wires to identical and repeatable acceleration levels regardless of variations in the design and construction of the rapper rod assembly or framework holding the electrodes or plates.

DETAILED DESCRIPTION OF THE INVENTION

Figure 1:
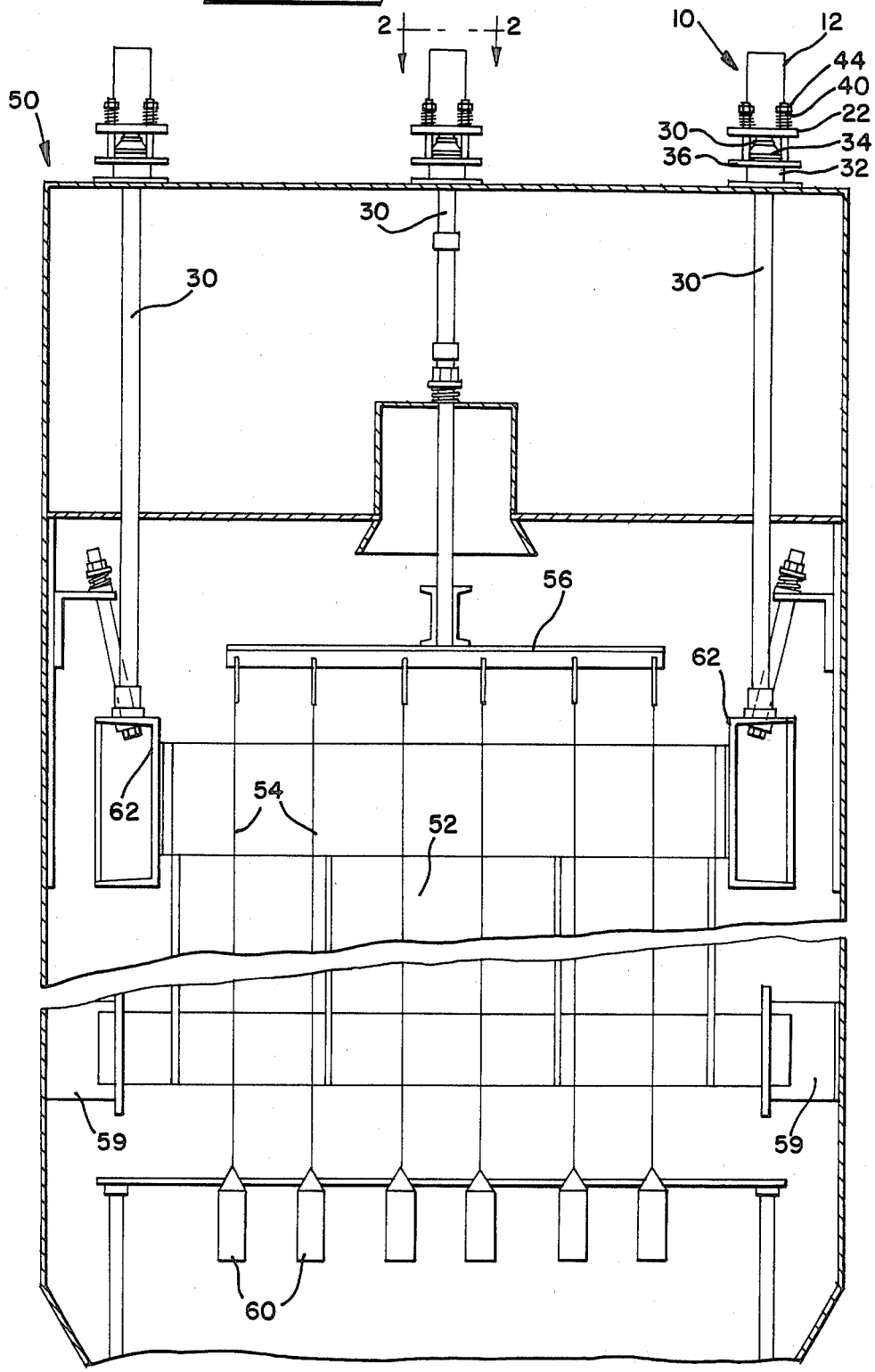
FIG. 1 is an elevation view showing an electrostatic precipitator with a set of collector plate electrodes adapted to be vibrated by piston vibrators of the present invention.

In the construction illustrated in FIG. 1, an electrostatic precipitator 50 is shown in the shape of a hopper, which precipitator includes a plurality of collector plate electrodes 52 which are grounded and a plurality of wire discharge electrodes 54 which are connected at one side of a high-tension, electric circuit (not shown). In some systems, polarity may be reversed. A top frame 56 supports the wire electrodes 54 in spaced relation with the plate electrodes 52 and with each other. A pair of anvil beams 62 support the collector plates 52. A pair of collector guides 59 align and space the collector plates 52. Weights 60 are suspended from the end of each wire electrode 54 to hold the wires taut. A plurality of rapping rods 30 are shown disposed between piston vibrators 10 of the present invention and anvil beams 62 disposed at either end of collector plates 52. This is a popular design, but there are many other precipitator designs which perform a similar function.

Figure 2:
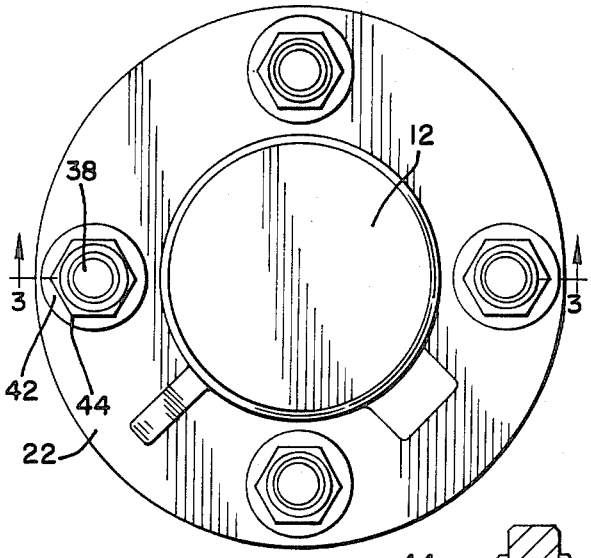
FIG. 2 is a top view in section taken along the lines 2—2 in FIG. 1.
Figure 3:
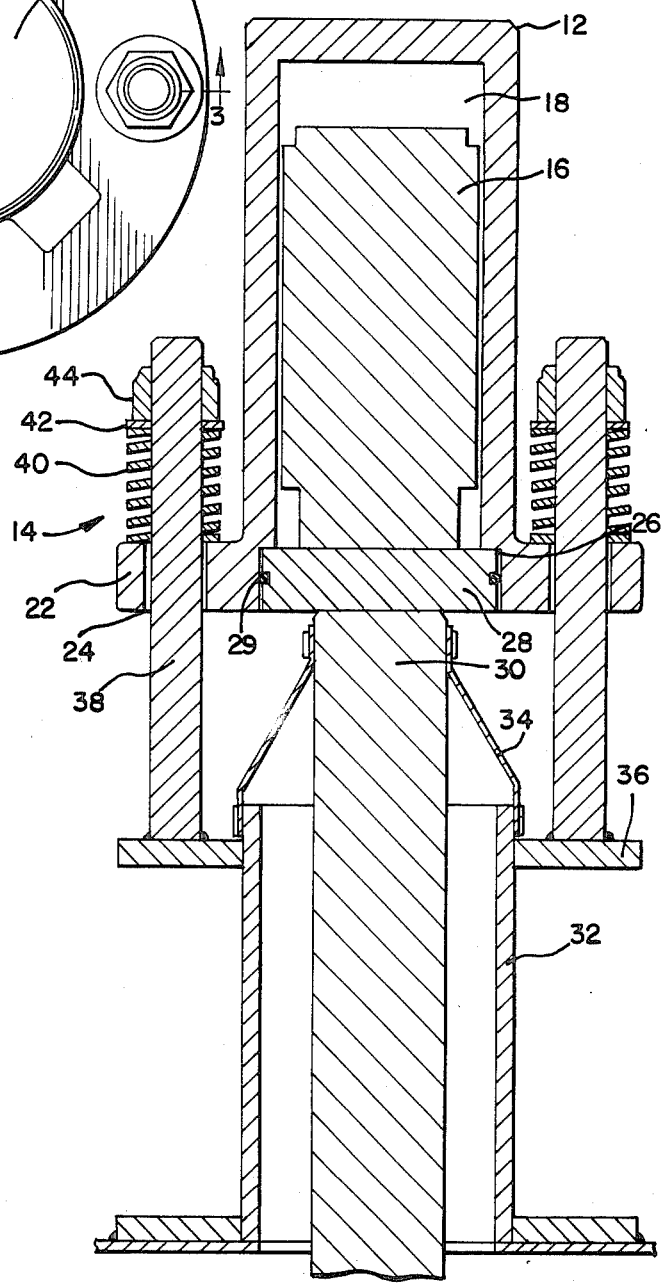
FIG. 3 is a side view in section taken along the lines 3—3 in FIG. 2.

FIGS. 2 and 3 show the piston vibrator 10 of the present invention in greater detail. The vibrator 10 includes a housing 12, a piston 16, a cylinder 18, and a selective adjustment mechanism, generally indicated by the number 14. The housing 12 is substantially cylindrical defining a cylinder 18 interiorly thereof open at its lower end and closed at its upper end. The piston 16 is slidably disposed within cylinder 18. A mounting flange 22 is disposed about the circumference of the base of the housing 12. A plurality of apertures 24 are provided in the mounting flange 22, each aperture spaced equidistant from each other aperture. A chamber or groove 26 is provided at the base of the housing, below the cylinder 18, such that the diameter of the chamber 26 is larger than the diameter of the cylinder 18. A strike surface shown in the form of a strike plate 28 is sized to be mounted in the chamber 26 and to be movable therein. A seal 29 is disposed between the side wall of the strike plate 28 and the side wall of the chamber 26.

Rapping rod 30 is positioned below the strike plate 28. A mounting collar 32, which is substantially tubular-shaped, encircles the rapping rod 30 and is secured on the top of the precipitator 50. A substantially frusticonical-shaped seal or boot 34 is disposed about the top of the collar 32, whereby the narrow end of the seal 34 is clamped around the upper end of the rapping rod 30 just below the strike plate 28 and the wide end of the seal 34 is clamped around the upper end of the collar 32 thereby protecting against airborne contaminants entering or being discharged from the precipitator.

The selective adjustment mechanism 14 includes a flange 36 secured about the periphery of the collar 32, just below the seal 34. A plurality of threaded rods 38 are supported by the flange 36 and are positioned so that their location corresponds to the location of the apertures 24 in the mounting flange 22. A tensioning spring 40 is placed over each rod 38 engaging the flange 22. A washer 42 and lock nut 44 secure the springs 40 in place. The springs 40 act to isolate the housing 12 from the shock of the piston 16 impact.

In operation, the vibrator housing is oriented such that the apertures 24 are aligned with the threaded rods 38, and the flange 22 is positioned over the rods with the nuts 44 snugged in place over the springs 40. This aligns the central axis of the piston 16 with the central axis of the rapping rod 30. When the vibrators are mounted vertically above the rapping rods, as shown in FIG. 1, no slack exists between the strike surface 28 and rod 30. In other arrangements, for example where the rapping rods extend horizontally out of the side of the precipitator, adjustment to eliminate slack is required. The position of the vibrator housing 12 and associated strike plate 28 or other strike surface may be adjusted with respect to the rapping rod 30 by tightening the nuts 44, thereby eliminating any slack between the strike plate 28 and the rapping rod 30. Direct contact between the strike plate 28 and the rapping rod 30 increases the force transmitted to the rod by 10 to 30 percent.

After the housing 12 and rapping rod 28 have been brought into engagement, the force exerted by the housing 12 and the strike plate 28 on the rapping rod 30 may be varied by further adjusting the pre-load in the same manner as described above. Tightening the nuts 44 increases the pre-load, and loosening the nuts 44 decreases the pre-load. Tuning the pre-load on each rapping rod 30 and its corresponding plates or wires permits identical acceleration levels for each vibrator regardless of variations in the design and construction of the rapping rod assembly or framework holding the electrodes or plates, thereby permitting optimum force transmission. This tuning can be easily done by means of on-site testing using an accelerometer. This arrangement also allows fine tuning of the system to compensate for changes which occur due to expansion or contraction as the operating temperature varies. It also provides a mechanism for automatically aligning the vibrator with the central axis of the rapping rod. The settings can be checked and changed while the vibrator is in operation.

It has been found that merely pre-loading the rapper rod does not produce the maximum efficiency in force transmission. In some instances, if the pre-load is insufficient, force is not effectively transmitted resulting in less predictable levels of acceleration. Surprisingly, if the pre-load is too great, a similar result occurs with acceleration forces less than optimum. It is thus a major advantage to be able to selectively adjust the pre-load between each vibrator and its corresponding rapping rod to tune the system to optimum acceleration levels which are uniformly reproducible regardless of variations within the precipitator.

It will be noted that in the drawings herein, no specific mechanism has been disclosed to activate the piston and cause it to rise from the position illustrated in FIG. 3 and then fall rapidly impacting against the strike plate 28. Numerous such activating mechanisms are well known to those of ordinary skill in the art including electromagnetic, gravity and pneumatic arrangements, and all such arrangements can be utilized with the vibrator of the present invention.

The piston vibrator of the present invention has been illustrated and described in conjunction with an electrostatic precipitator, but it can be used in other environments in which a piston vibrator is used to periodically accelerate some other object. Some examples are baffle plates or turning vanes, but other uses will occur to one skilled in the art.

The strike plate 28 of the vibrator has been described as an element which is separate from the housing and movable relative thereto. This is the preferred embodiment. It would be within the purview of the present invention, however, to provide a striking surface at the bottom of the cylinder 18 which is integral to the housing against which the piston 16 would impact. In other embodiments, it has been determined that the strike plate could be modified to incorporate a tapered adaptor for use with rappers having tapered ends as illustrated in U.S. Pat. No. 2,985,802.

Various features of the invention have been particularly shown and described in connection with the illustrated embodiment of the invention, however, it must be understood that these particular arrangements merely illustrate and that the invention is to be given its fullest interpretation within the terms of the appended claims.

What is claimed is:

1. A piston vibrator including a housing, a cylinder defined in said housing, a piston slidably disposed in said cylinder, a strike surface associated with said housing and disposed between said piston and a member to be vibrated, means to activate said piston whereby said piston is caused to periodically impact against said strike surface, and selective adjustment means associated with said housing adjustable to selectively vary a pre-load exerted by said housing and strike surface on said member to be vibrated.

2. A piston vibrator as in claim 1 in which said strike surface consists of a strike plate which is movable with respect to said housing.

3. A piston vibrator as in claim 2 including a chamber defined by said housing in which said strike plate is disposed.

4. A piston vibrator as in claim 3 including a seal member disposed between said strike plate and a wall of said chamber.

5. A piston vibrator as in claim 1 in which said selective adjustment means include a plurality of rods threaded at one end, a mounting flange connected to said housing defining a plurality of apertures therein, each aperture of a size sufficient to receive one of said rods extending therethrough, a nut threadably received on the end of each of said rods, and resilient biasing means disposed between said nut and said mounting flange whereby rotation of said nuts is effective to exert and vary said load exerted by said housing and strike surface on said member to be vibrated.

6. A piston vibrator as in claim 1 in which said member to be vibrated consists of a rapping rod associated with an electric precipitator.

* * * * *